US005899386A

United States Patent [19]

Miyasato et al.

[11] Patent Number: 5,899,386

[45] Date of Patent: May 4, 1999

[54] SPRINKLER ROTOR CONVERSION AND METHOD FOR ITS USE

[75] Inventors: Wayne M. Miyasato, Torrance; Michael R. Deater, Rancho Cucamonga; Kenneth J. Moorehead, West Covina, all of Calif.

[73] Assignee: Anthony Manufacturing Corp., Azusa, Calif.

[21] Appl. No.: 08/925,912

[22] Filed: Aug. 12, 1997

[51] Int. Cl.[6] ..... B05B 3/00; B05B 3/04; B05B 15/00

[52] U.S. Cl. ..... 239/289; 239/206; 239/240

[58] Field of Search ..... 239/237, 289, 239/240, 204, 206, 1

[56] References Cited

U.S. PATENT DOCUMENTS

| | | |
|---|---|---|
| 3,930,618 | 1/1976 | Lockwood . |
| 4,182,494 | 1/1980 | Wichman et al. . |
| 4,253,608 | 3/1981 | Hunter . |
| 4,417,691 | 11/1983 | Lockwood . |
| 4,625,914 | 12/1986 | Sexton et al. . |
| 4,681,259 | 7/1987 | Troup et al. . |
| 4,850,532 | 7/1989 | Mackanos ..... 239/1 |

*Primary Examiner*—Andres Kashnikow
*Assistant Examiner*—Sean P. O'Hanlon
*Attorney, Agent, or Firm*—Kelly Bauersfeld Lowry & Kelley, LLP.

[57] ABSTRACT

An adapter is provided for converting an irrigation sprinkler from an open case impact drive rotor to a closed case drive rotor, without requiring disinterment or replacement of a sprinkler case having the drive rotor housed therein. The conversion adapter comprises a generally cylindrical adapter sleeve for installation into the sprinkler case following lift-out removal of the open case drive rotor upon disengagement of a lock member such as a snap ring. The exterior surface geometry of the adapter sleeve is shaped to define a gap between the adapter sleeve and the top of the sprinkler case sufficient to permit re-engagement of the lock member to retain the adapter sleeve within the sprinkler case. The interior surface geometry of the adapter sleeve is shaped to receive and support the closed case drive rotor which is retained therein by an additional lock member such as a snap ring. An annular cap plate is mounted at the top of the sprinkler case to bridge and close the gap between the adapter sleeve and the sprinkler case.

14 Claims, 5 Drawing Sheets

SPRINKLER ROTOR CONVERSION AND METHOD FOR ITS USE

BACKGROUND OF THE INVENTION

This invention relates generally to irrigation sprinklers, and more particularly to irrigation sprinklers of the type having a drive rotor for rotatably driving a spray head through a selected full-circle or part-circle rotary path. More specifically, this invention relates to a conversion adapter for use in quickly and easily converting an irrigation sprinkler from an open case drive rotor to a closed case drive rotor.

Irrigation sprinklers are well known in the art for use in supplying irrigation water over a circular or part-circular ground area around the sprinkler. Typically, such sprinklers employ single or multiple outlet spray nozzles through which the water is ejected upwardly and radially outwardly from a sprinkler case or housing, and include a rotary drive means for rotating the spray nozzle to sweep the stream or streams of irrigation water over the desired terrain area. In many sprinklers, the spray nozzle comprises part of a pop-up mechanism which is designed for pressure responsive movement within the sprinkler case between an elevated position with the spray nozzle above the sprinkler case during normal operation and a retracted position withdrawn substantially within the sprinkler case when the sprinkler is not in operation. In a common installation, the sprinkler case has a lower end thereof connected to an underground water supply line, with the sprinkler case partially buried to position the upper end thereof substantially at ground level.

In the past, impact drive mechanisms have comprised one particularly common form of rotary drive means for an irrigation sprinkler. In an impact drive mechanism, sometimes referred to as an open case drive rotor, an impact drive arm is biased by a spring for oscillatory swinging movement of a deflector into interrupting engagement with the water stream in a manner causing the drive arm to repetitively impact the sprinkler body and thereby drive the sprinkler through a succession of small rotary steps. See, for example, U.S. Pat. No. 4,182,494. Reversal mechanisms are commonly employed to alter the direction of impact drive forces to achieve reversible rotation of the spray head between set end limits of an arcuate part-circle path. However, while impact drive or open case rotor sprinklers have been widely used with highly satisfactory results, the rotary drive and reversing components are necessarily exposed to the elements including sun, wind, precipitation, sand, grit, and the like, wherein such exposure can adversely affect sprinkler operation or result in premature failure. Moreover, such component exposure renders the sprinkler susceptible to vandalism.

In recent years, so-called closed case drive rotor sprinklers have been developed wherein the rotary drive and related reversing mechanisms are substantially enclosed or encased within a closed rotor housing for protection against exposure to the environment and unauthorized tampering. See, for example, U.S. Pat. Nos. 4,253,608 and 4,417,691 which disclose reduction gear trains driven by water turbines for rotatably driving a pop-up spray head of a sprinkler. See also U.S. Pat. Nos. 3,930,628 and 4,625,914 which disclose an impact drive ball arrangement for rotatably driving a pop-up sprinkler spray head. See U.S. Pat. No. 4,681,259 which discloses a reciprocal piston drive device for rotatably driving the sprinkler spray head.

As a result of the enhanced reliability and longevity of closed case drive rotor sprinklers, it is often desirable to upgrade an irrigation system to replace older open case impact drive rotor sprinklers with newer closed case drive rotor sprinklers. Such sprinkler replacement program has required the open case sprinklers to be disassembled from the associated underground water supply line, by disinterring the sprinkler case from the ground. A new closed case rotor sprinkler, including a new sprinkler case, has then been connected to the water supply line and appropriately buried to ground level. This replacement procedure is a costly, time consuming, and labor intensive process. It has not been possible to replace the drive rotor only, while re-using the existing sprinkler case, primarily because the existing sprinkler case is designed to accommodate the oscillatory impact drive arm and thus has a cross sectional size that is too large for a typical closed case drive rotor having a narrower profile.

The present invention relates to a relatively simple conversion adapter for mounting into the sprinkler case of an impact drive sprinkler, following removal of the open case drive rotor, to accommodate quick and easy mounting of a closed case drive rotor into the existing sprinkler case.

SUMMARY OF THE INVENTION

In accordance with the invention, a conversion adapter and related method are provided for quick and easy conversion of an irrigation sprinkler from an open case impact drive rotor to a closed case drive rotor. The adapter comprises an adapter sleeve for mounting into the sprinkler case of an existing irrigation sprinkler, following removal of an existing open case impact drive rotor therefrom. The adapter sleeve is designed to receive and support a closed case drive rotor within the existing sprinkler case, for normal pressure responsive pop-up and rotary drive operation to irrigate a surrounding terrain area.

The existing irrigation sprinkler comprises the sprinkler case of hollow construction to include an inlet fitting at a lower end thereof for connection to a typically buried water supply line, with an upper end of the sprinkler case positioned substantially at ground level. A pop-up sprinkler member is mounted within the sprinkler case for pressure responsive pop-up movement between a normal position retracted substantially within the sprinkler case, and an elevated position with a spray nozzle disposed above the sprinkler case to deliver an upwardly and radially outwardly directed water stream to the surrounding terrain. The sprinkler member includes a rotary drive means of the so-called open case rotor or impact drive type for rotating the spray head through a circular or part-circular path. The sprinkler member is removably mounted into the sprinkler case by a lock member, such as a removable snap ring.

The adapter sleeve has a generally cylindrical shape sized to fit into the sprinkler case, following removal of the existing sprinkler member and related open case drive rotor therefrom. The exterior surface geometry of the adapter sleeve defines an outwardly radiating shoulder to permit retention of the adapter sleeve within the sprinkler case by re-installation of the lock member. An upper end of the adapter sleeve cooperates with an upper end of the sprinkler case to define an annular gap sufficient to permit lock member re-installation.

The adapter sleeve further defines an interior surface geometry for receiving and supporting the replacement closed case drive rotor having a pop-up spray head for irrigating the surrounding terrain. In this regard, in the preferred form, the adapter sleeve defines an internal groove for receiving an additional lock member such as a snap ring for removably locking the closed case drive rotor therein. An annular cap plate is mounted in turn onto the adapter sleeve at the upper end thereof to bridge and close the gap at the top of the sprinkler case.

Other features and advantages of the invention will become more apparent from the following detained description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
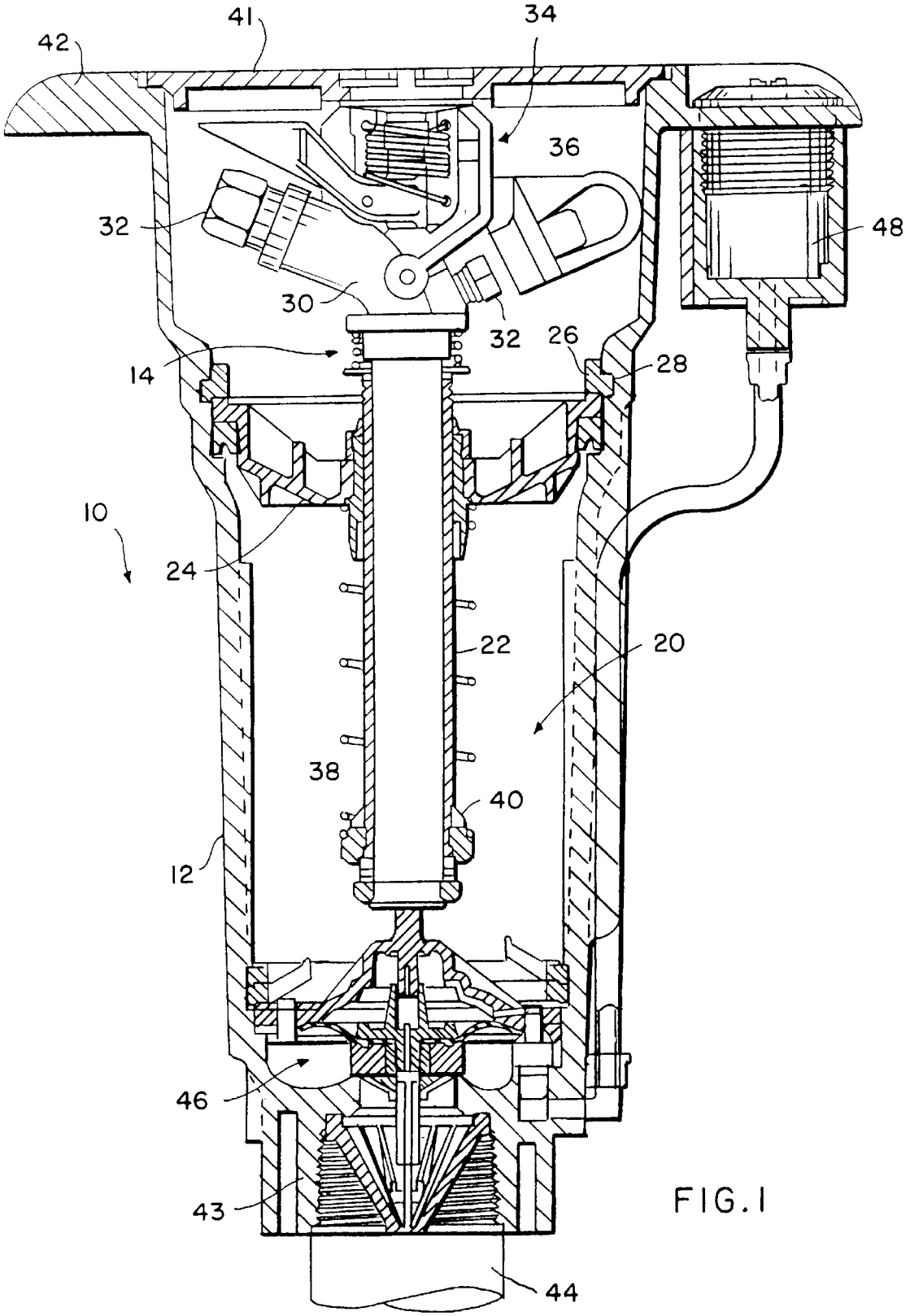
FIG. 1 is a vertical sectional view showing an irrigation sprinkler of the type having a sprinkler case with an open case impact drive rotor mounted therein.

As shown in the exemplary drawings, an irrigation sprinkler referred to generally by the reference numeral 10 in FIG. 1 includes a hollow sprinkler case 12 having a sprinkler head 14 of the open case impact drive rotor type mounted therein. The open case rotor head 14 is designed for quick and easy removal from the sprinkler case 12 (FIG. 2), followed by installation of a conversion adapter including an adapter sleeve 16 (FIGS. 3–5) for receiving and supporting a replacement sprinkler head 18 (FIG. 5) of the closed case drive rotor type. Accordingly, the adapter sleeve 16 permits sprinkler conversion to the closed case rotor head 18 without requiring removal or replacement of the existing sprinkler case 12.

The irrigation sprinkler 10 shown in FIG. 1 has a generally conventional overall construction and operation. More particularly, the illustrative sprinkler 10 comprises the sprinkler case 12 having a generally cylindrical construction of molded plastic or the like to define a hollow interior 20 for receiving and supporting the impact drive sprinkler head 14. This sprinkler head 14 comprises a tubular riser 22 mounted for longitudinal sliding movement within an annular bearing guide 24 which is secured within the case interior by a lock member such as a removable snap ring 26 or the like seated within a groove 28 formed in an interior wall surface of the case. An upper end of the riser 22 is connected above the bearing guide 24 to a spray head body 30 including at least one spray nozzle 32 for directing a stream of irrigation water in an upward and radially outward direction to irrigate the surrounding terrain area. FIG. 1 shows the spray head body to include a pair of spray nozzles 32, and further to include a conventional open case or impact rotary drive means 34 in the form of a spring-loaded impact drive arm 36 for repetitively interrupting one of the water streams and for impacting the spray head body 30 to rotate the spray nozzles 32 through a circular or selected part-circular path of motion, all in a manner known to persons skilled in the art. A retraction spring 38 reacts between the bearing guide 24 and a shoulder 40 at the lower end of the riser 22 for normally positioning the sprinkler head in a lowered position retracted and substantially concealed within the sprinkler case 12. A cover plate 41 is normally provided at the top of the spray head 14 for seated engagement with a flanged top 42 of the sprinkler case 12 to close the sprinkler case when the sprinkler head is in the retracted position.

In normal installation and operation, the sprinkler case 12 is partially buried in the ground with an inlet fitting 43 at a lower end thereof connected to an underground water supply line 44, and with an upper or top end of the case 12 disposed substantially at ground level. An inlet control valve 46 may be mounted within the case 12 generally at the inlet fitting 43 for controlling water flow to the sprinkler as the water supply is turned on and off. In this regard, the illustrative drawings show the inlet control valve in the form of a diaphragm-type pressure control valve operated by a regulator module 48 to control water supply into the sprinkler case 12 when the water supply is turned on, and further to prevent low pressure leakage of water into and through the sprinkler case, all in a manner known to persons skilled in the art and as further described in U.S. Pat. No. 4,637,548 which is incorporated by reference herein. When the water supply is turned on, the riser 22 pops up within the sprinkler case 12 to carry the spray nozzles 32 to an elevated position for delivering irrigation water streams to the surrounding terrain, and the impact-type rotary drive means 34 interrupts at least one of the projected water streams to rotatably drive the sprinkler. Commercially available impact drive sprinklers of this type include the Rain Bird 47/51 impact drive rotor series available from Rain Bird Sprinkler Mfg. Corp. of Glendora, Calif.

Figure 2:
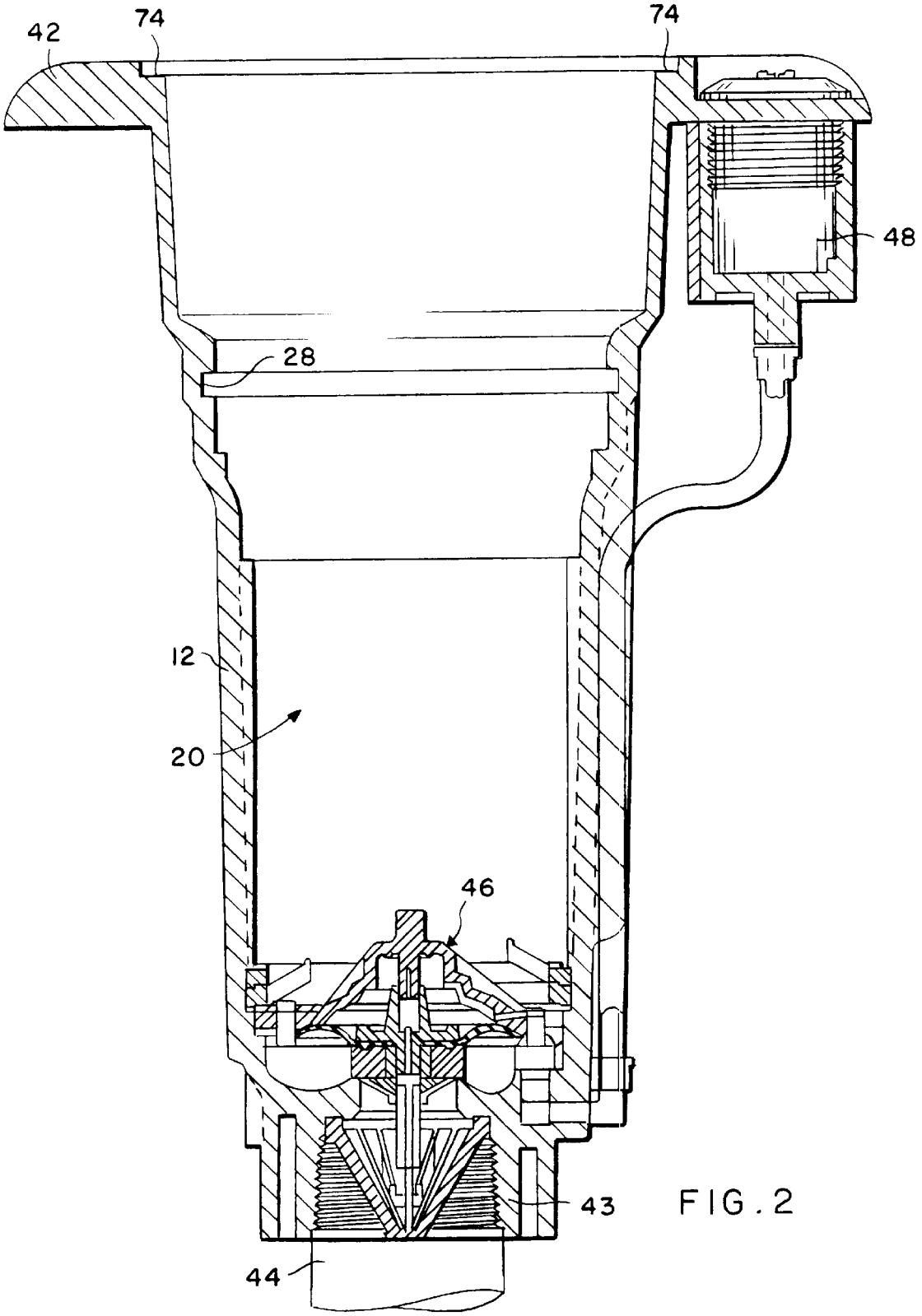
FIG. 2 is a vertical sectional view of the irrigation sprinkler of FIG. 1, but with the open case drive rotor removed from the sprinkler case.

When it is desired to remove and replace the sprinkler head 14 including the impact-type rotary drive means 34 (FIG. 1), the sprinkler head 14 is accessed quickly and easily by lifting the cover plate 41 to expose the underlying sprinkler head. The snap ring 26 can then be removed from the lock groove 28 by use of an appropriate tool (not shown) through the top of the sprinkler case 12, to permit lift-out removal of the entire sprinkler head, including the riser 22, the retraction spring 38, and the related bearing guide 24. FIG. 2 shows the hollow sprinkler case 12 with these components removed.

Figure 3:
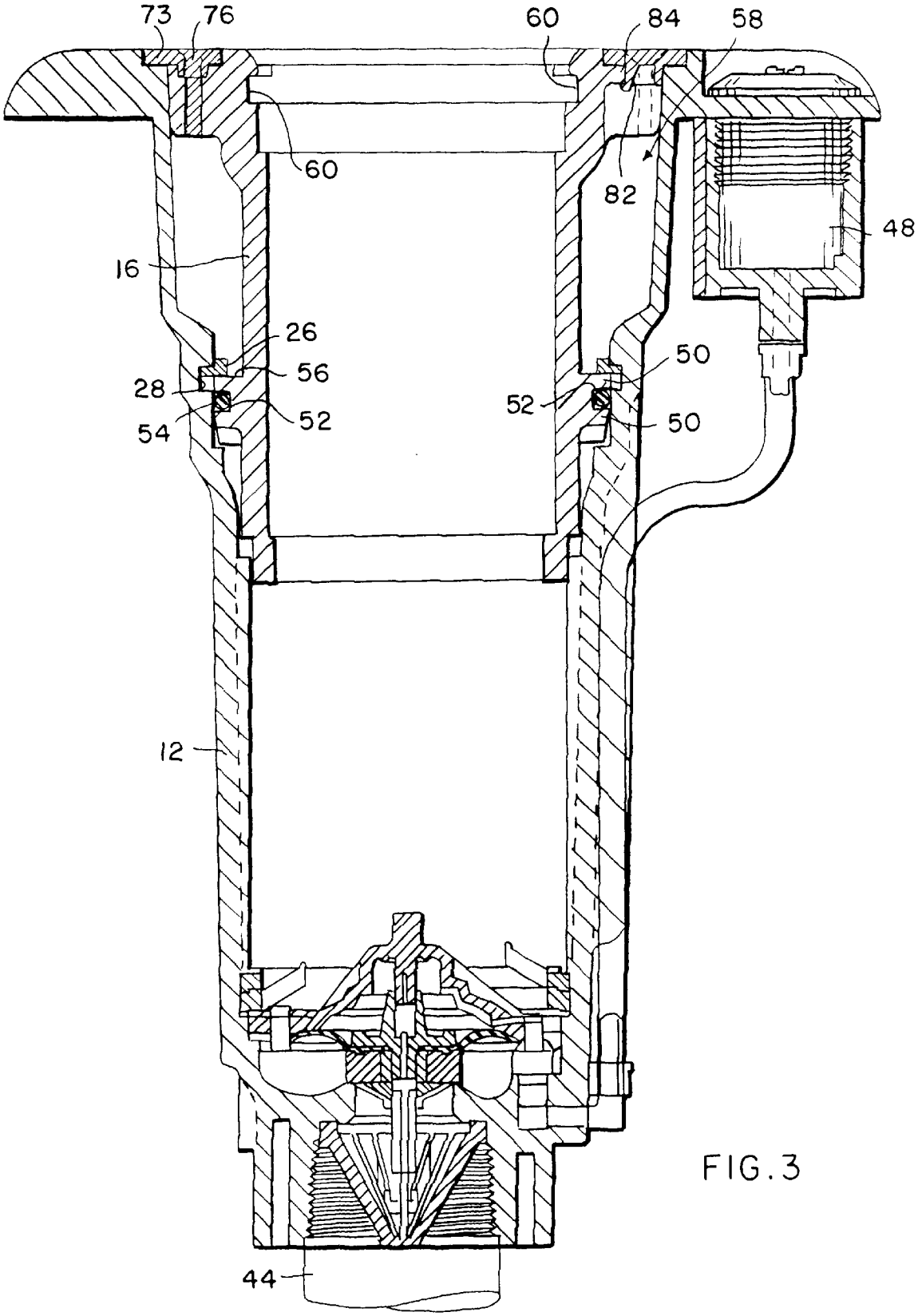
FIG. 3 is a vertical sectional view of the irrigation sprinkler case of FIG. 2, with an adapter sleeve constructed in accordance with the invention mounted therein.
Figure 4:
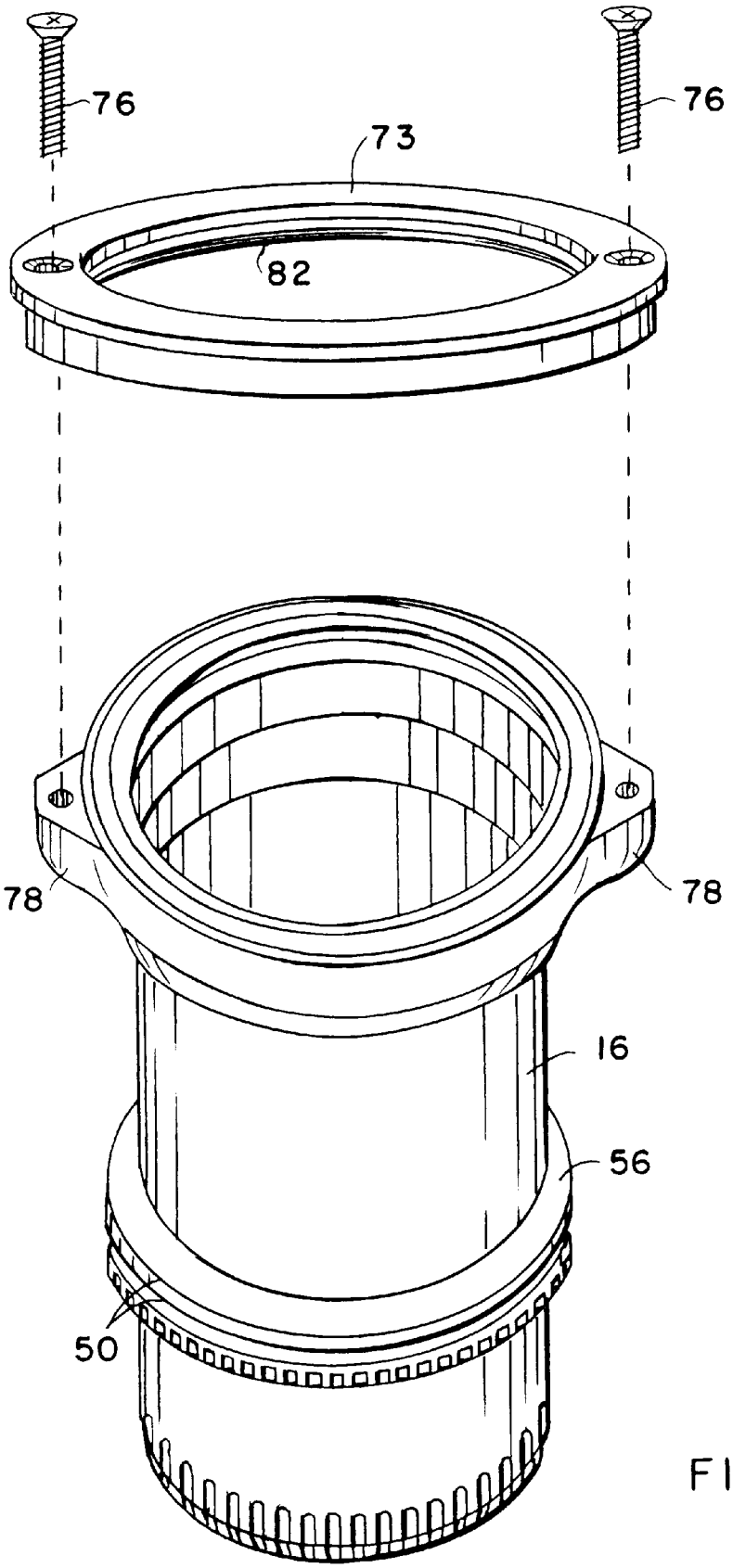
FIG. 4 is an exploded perspective view showing assembly of the adapter sleeve with an annular cap plate.

The conversion adapter of the present invention can then be installed quickly and easily, to prepare the existing sprinkler case 12 for installation of the replacement sprinkler head 18 of the closed case rotor type. More specifically, as shown in FIGS. 3 and 4, the adapter sleeve 16 comprises a generally cylindrical component having a size and shape for slide-fit installation directly into the open upper end of the sprinkler case 12 without requiring removal of the sprinkler case from the ground or disconnection thereof from the water supply line 44. In the preferred form, the adapter sleeve 16 includes a pair of outwardly radiating ribs 50 formed on the exterior surface thereof and near a lower end of the sleeve, wherein these ribs define a groove 52 therebetween for receiving and supporting a seal member 54 such as a conventional O-ring. These ribs 50 are located on the sleeve 16 whereby the upper rib also defines an upwardly presented shoulder 56 positioned for engagement by the snap ring 26 which is re-installed into the sprinkler case 12 to lock the adapter sleeve in place.

The shape of the upper end of the adapter sleeve 16 is tailored relative to the shape of the upper end of the sprinkler case 12 to permit re-installation of the snap ring 26. In particular, the upper end of the sprinkler case 12 normally has an expanded cross sectional dimension relative to a lower portion of the case to accommodate the impact drive arm 36 of the open case impact drive means 34. The upper end of the adapter sleeve 16 is shown to be sufficiently smaller in cross sectional size, relative to the upper end of the sprinkler case 12, to define an annular gap 58 (FIG. 3) between these components. This gap 58 is sufficient is size to permit access to the snap ring 26 for re-installation into the sprinkler case.

Figure 5:
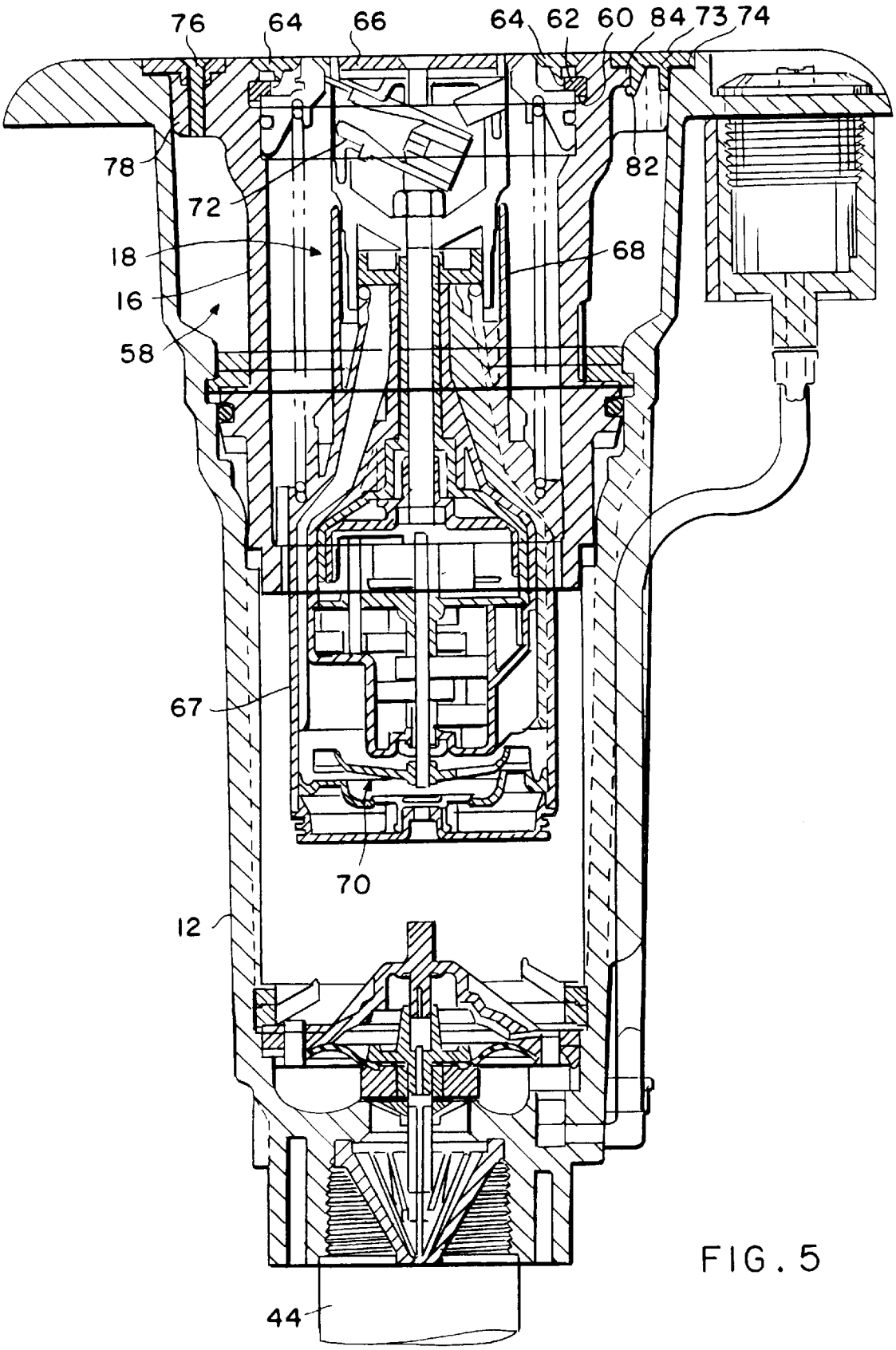
FIG. 5 is a vertical sectional view similar to FIG. 3, and showing the adapter sleeve and cap plate mounted in the sprinkler case, further to include a closed case drive rotor mounted in the sprinkler case.

As shown in FIG. 5, the adapter sleeve 16 has an interior surface geometry for receiving and supporting the replacement sprinkler head 18 of the closed case rotor type. As shown, the adapter sleeve 16 is shaped to include an internal lock groove 60 near an upper end thereof for seated reception of an additional lock member such as a snap ring 62 for securing the replacement sprinkler head 18 into the adapter sleeve. This additional snap ring 62 is desirably concealed by a snap fit annular seal ring 64 mounted at the top of the sprinkler head as a portion of a cover plate 66 therefor. In operation, the replacement sprinkler head 18 includes a closed case housing 67 including a pop-up riser 68 and a related drive motor 70 such as a turbine or ball drive assembly for rotatably driving a spray nozzle 72 in a manner sweeping an irrigation water stream over a prescribed terrain area. Sprinkler heads of this so-called closed case rotor type are known in the art, for example, by reference to U.S. Pat. Nos. 4,681,259; 4,525,914; 5,240,182; and 5,240,184 which are incorporated by reference herein. Commercially available closed case drive rotor sprinklers of this type include the Rain Bird 900/950 rotor series sprinklers available from Rain Bird Sprinkler Mfg. Corp. of Glendora, Calif.

The conversion adapter of the present invention additionally includes an annular cap plate 73 (FIGS. 4 and 5) for closing the gap 58 used to re-install the snap ring 26. This cap plate 73 is sized and shaped to partially overlie the upper ends of the adapter sleeve 16 and the sprinkler head 18, seated within a shallow recess 74 (FIG. 5) cooperatively defined by these structures. A pair of mounting screws 76 are provided for securely attaching the cap plate 73 to a corresponding pair of outwardly radiating wings 78 located at the upper end of the adapter sleeve 16 and having threaded bores formed therein. In addition, the cap plate 73 includes an angularly oriented snap leg 82 (FIG. 5) formed on the underside thereof for releasably engaging an outwardly radiating rim 84 formed on the adapter sleeve 16 near the upper end thereof. Accordingly, the cap plate 73 bridges and closes the gap 58 in an attractive and inobtrusive manner, but can be removed quickly and easily in the event that access to the snap ring 26 is necessary or desirable for maintenance purposes.

The conversion adapter of the present invention thus provides a relatively simple adapter device and method for quickly and easily converting an existing irrigation sprinkler of the open case drive rotor type for use with an alternative drive rotor of the closed case type, without requiring disinterment or replacement of the existing sprinkler case 12. Instead, the replacement drive rotor is mounted quickly and easily into the existing case, by means of the adapter sleeve 16, so that the sprinkler can be promptly returned to service without disturbing the surrounding soil.

A variety of modifications and improvement in and to the conversion adapter of the present invention will be apparent to those skilled in the art. Accordingly, while a particular form of the invention has been illustrated and described herein, it will be understood that no limitation on the invention is intended by way of the foregoing description and accompanying drawings, except as set forth in the appended claims.

What is claimed is:

1. A conversion adapter for use in combination with an irrigation sprinkler having a hollow sprinkler case with an open case drive rotor removably mounted therein by a releasible lock member, to permit installation of a closed case drive rotor into said sprinkler case, and conversion adapter comprising:

an adapter sleeve having a size and shape for slide-fit reception into the sprinkler case following lift-out removal of the open case drive rotor upon release of the lock member, said lock member being re-engageable with the sprinkler case and said adapter sleeve to retain said adapter sleeve within said sprinkler case;

said adapter sleeve having an interior surface geometry for receiving and supporting the closed case rotor within the sprinkler case;

an upper end of the sprinkler case and an upper end of said adapter sleeve cooperatively defining an upwardly open and generally annular gap therebetween, when said adapter sleeve is received into the sprinkler case, to permit re-engagement of said lock member with the sprinkler case and adapter sleeve to retain said adapter sleeve within the sprinkler case.

2. The conversion adapter of claim 1 wherein said lock member comprises a snap ring.

3. The conversion adapter of claim 1 further including an additional lock member engageable with said adapter sleeve and the closed case drive rotor received therein for retaining the closed case drive rotor within said adapter sleeve.

4. The conversion adapter of claim 3 wherein said additional lock member comprises a snap ring.

5. The conversion adapter of claim 1 further including a cap plate of generally annular shape mounted on the sprinkler generally at an upper end thereof to bridge and close said gap following re-engagement of said lock member with the sprinkler case and said adapter sleeve.

6. The conversion adapter of claim 1 further including a cap plate of generally annular shape mounted on said adapter sleeve generally at the upper end thereof to bridge and close said gap following re-engagement of said lock member with the sprinkler case and said adapter sleeve.

7. A conversion adapter for use in combination with an irrigation sprinkler having a hollow sprinkler case with an open case drive rotor removably mounted therein by a releasible lock member, to permit installation of a closed case drive rotor into said sprinkler case, said conversion adapter comprising:

an adapter sleeve having a size and shape for slide-fit reception into the sprinkler case following lift-out removal of the open case drive rotor upon release of the lock member, said lock member being re-engageable with the sprinkler case and said adapter sleeve to retain said adapter sleeve within said sprinkler case;

said adapter sleeve having an interior surface geometry for receiving and supporting the closed case drive rotor within the sprinkler case;

an upper end of the sprinkler case and an upper end of said adapter sleeve cooperatively defining an upwardly open and generally annular gap therebetween, when said adapter sleeve is received into the sprinkler case, to permit re-engagement of said lock member with the sprinkler case and adapter sleeve to retain said adapter sleeve within the sprinkler case; and a cap plate of generally annular shape mounted on the sprinkler generally at an upper end thereof to bridge and close said gap following re-engagement of said lock member with the sprinkler case and said adapter sleeve.

8. The conversion adapter of claim 7 wherein said lock member comprises a snap ring.

9. The conversion adapter of claim 7 further including an additional lock member engageable with said adapter sleeve and the closed case drive rotor received therein for retaining the closed case drive rotor within said adapter sleeve.

10. The conversion adapter of claim 9 wherein said additional lock member comprises a snap ring.

11. The conversion adapter of claim 7 wherein said cap plate is mounted on said adapter sleeve generally at the upper end thereof.

12. A method of converting an irrigation sprinkler having a hollow sprinkler case with an open case drive rotor removably retained therein by a releasible lock member, to permit installation of a closed case drive rotor into the sprinkler case, said method comprising the steps of:

releasing the lock member and removing the open case drive rotor from the sprinkler case by lift-out removal therefrom;

slide-fit mounting an adapter sleeve into the sprinkler case;

re-engaging the lock member with the sprinkler case and the adapter sleeve to retain the adapter sleeve within the sprinkler case; and mounting the closed case drive rotor within the adapter sleeve.

13. The method of claim 12 wherein the upper ends of the sprinkler case and adapter sleeve are formed to cooperatively define an upwardly open and generally annular gap therebetween to permit said lock member re-engaging step, and further including the step of mounting a cap plate onto the sprinkler to bridge and close said gap following said lock member re-engaging step.

14. The method of claim 13 wherein said cap plate mounting step comprises mounting the cap plate to the adapter sleeve generally at the upper end thereof.

* * * * *